United States Patent [19]

Chakravorty

[11] Patent Number: 4,790,490

[45] Date of Patent: Dec. 13, 1988

[54] SELF-LOCKING, DRIVER MECHANISM REGULATED TISSUE DISPENSING SYSTEM WITH HANDS-FREE OPERATION OPTION

[76] Inventor: Shyamal Chakravorty, 7360 Silver Pine Dr., Springfield, Va. 22153

[21] Appl. No.: 162,211

[22] Filed: Feb. 29, 1988

[51] Int. Cl.[4] ..... B65H 19/00; B65H 35/00

[52] U.S. Cl. ..... 242/55.53; 242/68.5; 225/16; 225/43; 225/46; 225/106; 312/38

[58] Field of Search ..... 242/55.2, 55.53, 68.5; 312/37, 38, 39; 225/10, 16, 39, 41, 43, 46, 47, 106

[56] References Cited

U.S. PATENT DOCUMENTS

| | | | |
|---|---|---|---|
| 4,662,578 | 5/1987 | Chakravorty | 242/55.53 |
| 4,666,099 | 5/1987 | Hoffman et al. | 242/55.53 |
| 4,721,265 | 1/1988 | Hawkins | 242/55.53 |

*Primary Examiner*—David Werner

[57] ABSTRACT

Described is a device designed to dispense tissue paper or cloth web by a self-locking dispenser system. The dispenser system consists of a release mechanism which is activated by hands-on mechanical or hands-free elec-to-mechanical means. The gear train in the dispenser mechanism is connected to the tissue or towel roll axle and thus regulates the motion of the roll. The dispensing system, in activated mode, allows free passage of the tissue or towel web out of the dispenser through an opening in the dispenser housing but, in the released position, itself locks up the tissue or towel web in this opening with a tight prong device thus prohibiting the web from further movement. This is accomplished without locking up the roll axle. The whole system including the roll is installed inside an air-tight housing which allows usage of dry as well as moistened tissue or towel. The dispenser housing is provided with a movable, transparent front cover to provide visibility to the extent of roll usuage. Finally, the dispenser housing has the optional means to provide manual dispensing of the web free from the self locking mechanism.

6 Claims, 4 Drawing Sheets

SELF-LOCKING, DRIVER MECHANISM REGULATED TISSUE DISPENSING SYSTEM WITH HANDS-FREE OPERATION OPTION

BACKGROUND OF THE INVENTION

Until now tissue paper or towel dispensing systems have been designed based on force-fed roller systems or spring based gear trains. Such designs necessitate the towel web to be dry, tough and tenacious. In the spring based dipensing system, the spring has to be specially tight to trap the released web and prevent it from further slippage. Dispensers of this type are found in U.S. Pat. Nos. 3,084,664; 2,989,024; 4,662,578; 3,843,218 and 4,406,421. The last two patents incorporate complex and expensive gear and clutch mechanisms. In U.S. Pat. No. 4,662,578 the gravity based driving gear pins and the teeth of the driven gear tend to lock up and inhibit smooth dipensing of the roll. The size of the driven gear is restricted by the number of teeth and therefore has limited efficiency and size. Furthermore, in the absence of locking or clutch system, the rebound spring attached to the towel web release mechanism has to be extremely tight to prevent slippage of the web. This makes it virtually impossible to relieve the tissue web with a gentle push of associated dispensing lever. Also, all prior art dispensing systems have large openings in the dispenser housing. This prohibits usuage of moistened rolls since the moisture would be dissipated by evaporation through the multiple openings.

The present invention provides means for an air-tight dispenser housing with an air-tight, self-locking passageway for dipensing the web and this passageway is opened only when the web is being relieved. Also the hands-free operation option provides a facility for disabled people to use the dispensers.

Therefore, it is an objective of the present invention to provide a simple, inexpensive, dry or moistened tissue or towel dispensing system that employs a light spring based, self-locking dispensing mechanism with options for hands-free operation as well as an option for a total avoidance of use of the driving mechanism altogether to dispense the tissue or towel web. Another objective of the present invention is to provide an air-tight, hygienic dispenser system, with features for locking, that can contain dry or moistened tissue or towel for long periods of time.

SUMMARY OF THE INVENTION

The invention relates to a controlled tissue or towel dispensing system that is used with limited human interface for public facilities such as hospitals, doctors' offices, research laboratories, industrial, commercial and other institutional facilites including households.

The design described herein maximizes the efficiency of the dispenser since minimum human interface is required to activate and control the release of the tissue or towel. The design further incorporates a simple locking mechanism. When the driver mechanism is in the released position, the locking mechanism ensures that the dispenser passageway is shut tight and locked thus preventing any material, including a tissue or towel web, to slip past it.

The option for the electro-mechanical remote activation of the dispensing system with its self-locking mechanism provides the same dispensing facility.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure.

The scope of the invention is defined in the claims appended hereto.

Figure 2:
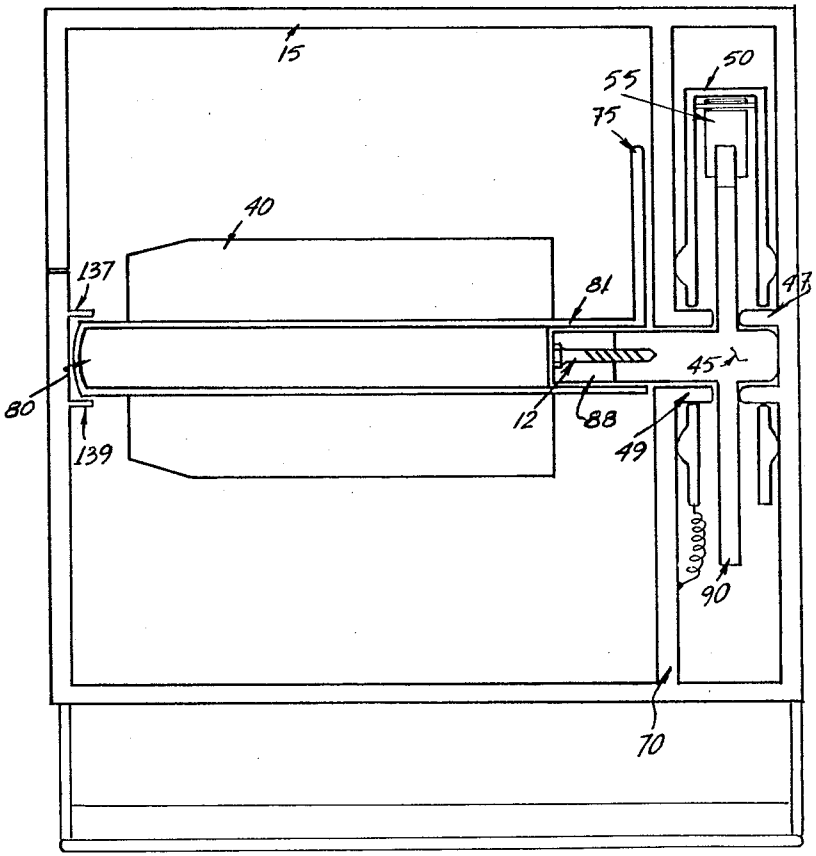
FIG. 2 is the sectional elevation of the system along line 1—1 of FIG. 1.
Figure 1:
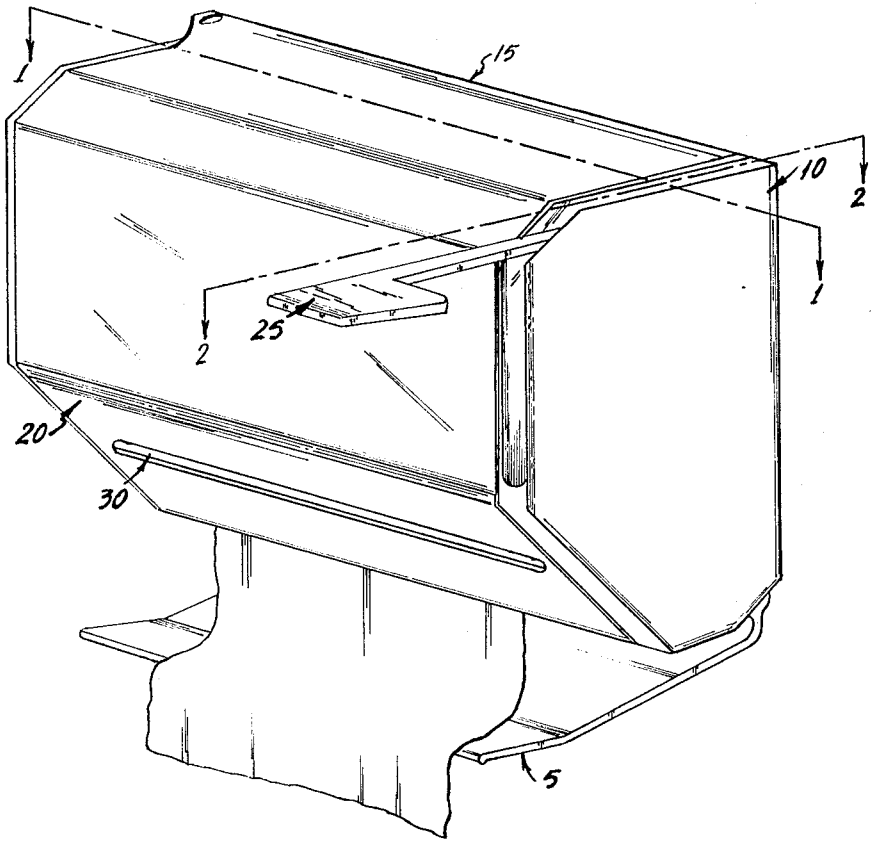
FIG. 1 is an isometric view of the dispenser housing embodying the drive mechanism, the locking lifter pin, the drive train, the lip release mechanism, movable front transparent cover and the web drop guide.

As shown in FIG. 1, the simplified, lightweight tissue or towel dispenser is made with high plastic, such as polystyrene, wood or similar other materials by integrating the basic subsystems consisting of the dispenser housing or cabinet 15, the lip release mechanism 20, with a longitudinal opening 30, a central drive train and a drive mechanism. The tissue or towel roll drive mechanism, consisting of central axis 45 (FIG. 2) and outer driver gear 50 (FIG. 2), is located at one end of the cabinet in a separate, small compartment isolated by a partitioning wall 70 (FIG. 2). This provides a clean appearance and an ease of handling of the tissue or towel roll. All basic components of the system are mounted on the drive train consisting of the axle of the tissue or towel roll holder 80 (FIG. 6) attached to the inner toothed gear plate 90 through the butt end 88 (FIG. 2). The outer driver gear is made of two halves; the lower stopper arm 27 (FIG. 7) is driven by the gear plate extension 25 (FIG. 7) or by electro-magnetic relay 135 (FIG. 9)—depending on the mode of use, hands-on or hands-free. The axial ends of the roll holder 80 and 81 (FIG. 2) extend into the axle mounts 47 and 137 at the two far end wall of the cabinet (FIG. 2).

Figure 11:
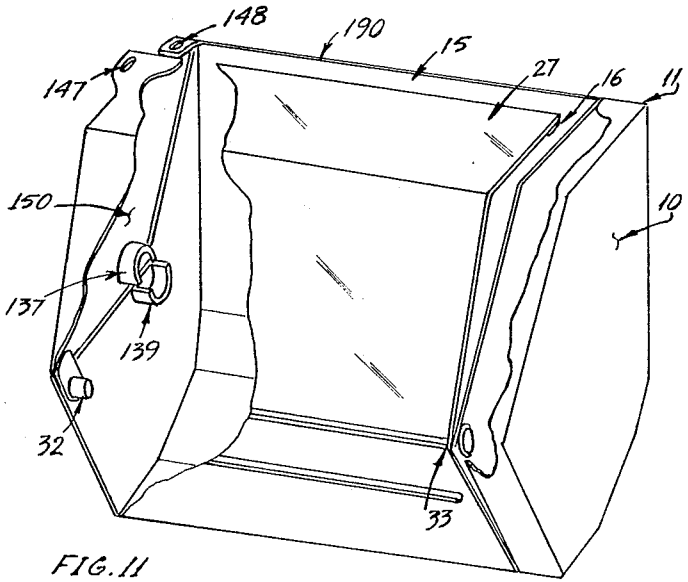
FIG. 11 is a partial, isometric view of the front, transparent cover with split sides carrying halves of roll holder axle mounts.

The dispenser housing or cabinet is mounted on to a wall or furniture with the help of screws driven through the back wall of the housing or with special mounting brackets not shown. The front of the housing consists of two halves. The upper half is a movable transparent cover mounted on hollow, tubular mount 32 (FIG. 11) attached to its left split side wall at one end and on similar mounting fixture 33 (FIG. 11) attached to its front plate at the other end. Looking toward the cabinet, the left side of the front cover consists of a portion of the left side plate 150 of the cabinet 15 (FIG. 11). The front top cover rotated freely about the tubular mounts 32 and 33 (FIG. 11). There is a hole 147 (FIG. 11) in an extended portion of the top left side of the front cover 27. This hole aligns itself with the hole 148 (FIG. 11) in an extension of the main housing body 15 (as shown in FIG. 11) when the front cover is closed. The two alignable holes provide means for locking the front cover to the main body of the cabinet thus preventing abusive use of the tissue or towel roll. The front cover is further lined with a compressible material 16 all along its peripheral edges to provide means for air-tight closure. The complementing peripheral edges of the dispenser housing is also lined with a compressible material 191(FIG.11).

Figure 4:
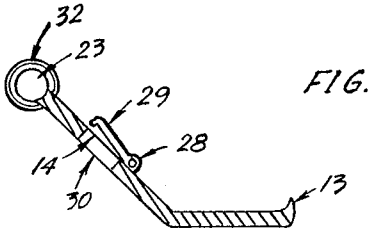
FIG. 4 is a sectional view of the bottom lip along line 5—5 of FIG. 3.
Figure 3:
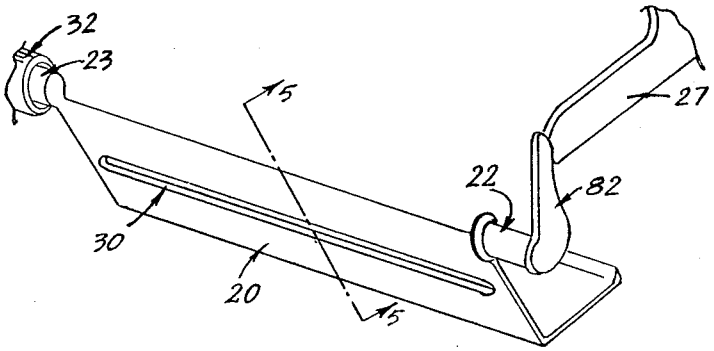
FIG. 3 is an isometric view of the bottom lip release system attached to the lifter pin.
Figure 8:
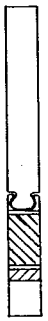
FIG. 8 is a sectional view of the outer gear piece along line 4—4 of FIG. 7.

The lower front cover consists of a drop lip mechanism 20 (FIG. 3) which has end axles 22 and 23 (FIG. 3) that rotate freely inside the tubular mounts 32 and 33 (FIG. 11) attached to the main body of the cabinet. The longitudinal slit opening 30 (FIG. 3) in the upper half of the lip permits the web of the tissue or towel to pass through in the event that the outer gear driver mechanism is not being used. When not in use, the slit opening 30 is maintained closed with a flap plate 29 that can be rotated aboout a hinge 28 located on its lower edge (FIG. 4).

Thus the top and the lower halves of the front cover of the cabinet are free to rotate about the same axis without interfering with each other at all.

At the bottom of the dispenser cabinet, a towel guide 5 (FIG. 1) directs the movement of the release tissue or towel toward the front of the cabinet.

Figure 6:
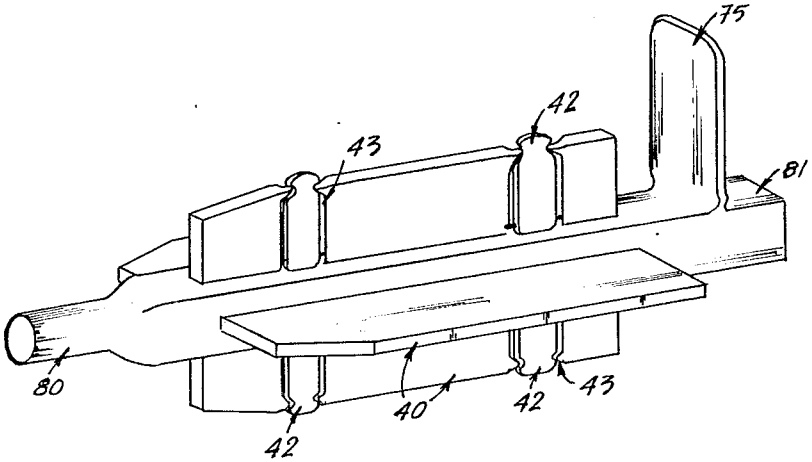
FIG. 6 is an isometric view of the axial tissue or towel roll holder.

The tissue or towel roll holder axle in FIG. 6 consists of a heavy shaft (for increased rotational momentum) with one cylinderical end 80 that sits in the bottom split axial mount 139 (FIG. 11) and is prevented from jumping out of it by the top split axial mount 137 (FIG. 11). The other end of the roll holder shaft 81 (FIG. 6) is a hollow square or a non-cylinderical hollow end that snugly fits on to the smaller, solid butt end of same shape (as the hollow end 81). This solid butt end 88 forms one end of the center of the inner toothed gear 90 (FIG. 2). Thus the rotary movement of the inner gear 90 is transmitted through its own axial butt end 88 to the roll holder (FIG. 2). The roll holder axle also has filler pins 42 (FIG. 6) that are rotatably mounted at their lower ends and when raised, these pins snap fit into the grooves 43 of the tapered fins 40 (FIG. 6). The grooves 43 in the axle fins 40 are shaped like inverse of letter S to provide means for snap fitting of the filler pins 42. The filler pins provided are of variable lengths but they are of same length on different opposite fins of the axle shaft. The different lengths of the filler pins provide means to allow different tissue or towel roll to snugly fit roll axle shaft.

The system works as described below.

The tissue or towel roll holder axle 80 is inserted into the roll's axial central hollow cylinderical body. Prior to inserting, it is made sure that the filler pins of proper lengths are raised and fit snugly into their respective grooves depending on the inner diameter of roll's axial cylinder. The roll is moved all the way toward the stopper plate 75 (FIG. 6).

The dispenser cabinet 15 is next opened by moving the top front cover 150 outward. The roll axial holder with the tissue or towel roll is then lowered into the cabinet and the hollow butt end 81 of the roll axle is placed next to the solid butt end 88 of the inner gear axle 45 (FIG. 2). The male solid end 88 is matched with the female hollow end 81 and the latter is inserted into the former. The round, solid axial end 80 of the roll holder axle is then placed into the lower split mounting fixture 139 in the left side of the dispenser housing 15 (FIG. 2).

Figure 5:
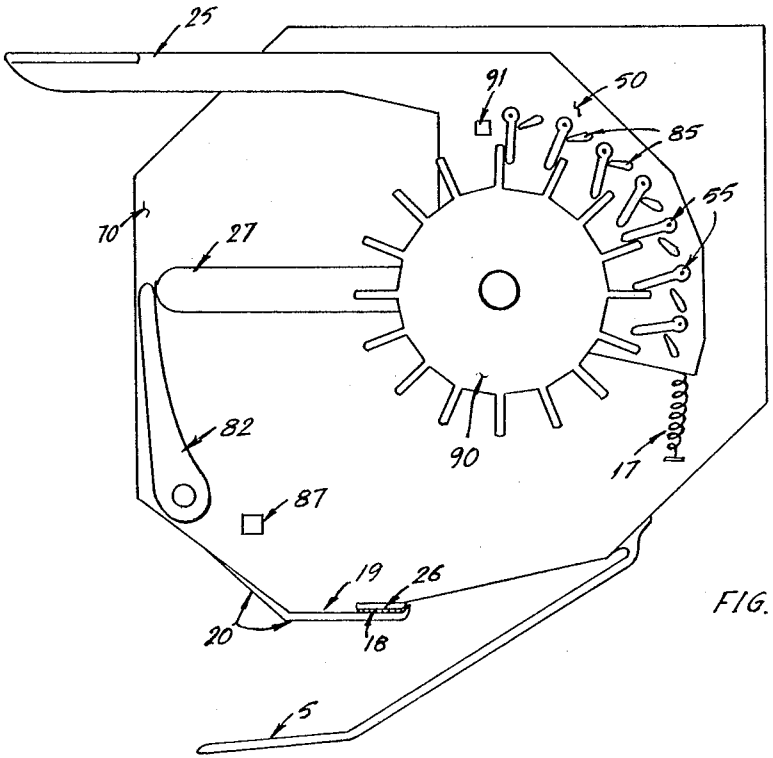
FIG. 5 is a sectional view of the inner toothed gear plate, in front of the outer, partially visible, driver gear, along line 2—2 of FIG. 1.

In the manual operation, the outer gear extension 25 (FIG. 5), extending outside of the dispenser housing, is pushed down. The drop pins 55 pivotally mounted about their top ends on the outer driver gear plate 50 move forward with the gear (FIG. 5). As the outer gear moves counter-clockwise about its central axial hollow mount 49 (FIG. 2) which is attached to the dispenser partitioning wall 70, the drop pins 55 push forward the inner toothed gear 90 by pushing down its peripheral teeth in the direction of the motion. The drop pins are themselves prevented from moving backward by the stoppers 85, which are protrusions on the outer gear plate 50 behind the drop pins. The drop pins act as movable pins of the outer gear. The restriction of the backward movement of the drop pins 55 prevent the inner gear 90 (FIG. 5) from moving backward. This ensures unidirectional, forward movement of the tissue or towel roll axial holder 80 and therefore of the roll itself. This further allows the tissue or towel web to descend toward the opening 19 at the bottom of the dispenser cabinet 15 (FIG. 5). The outer gear 50 comprises spherical protrusions on its outside walls which act as its guides in between the small compartment walls.

Figure 9:
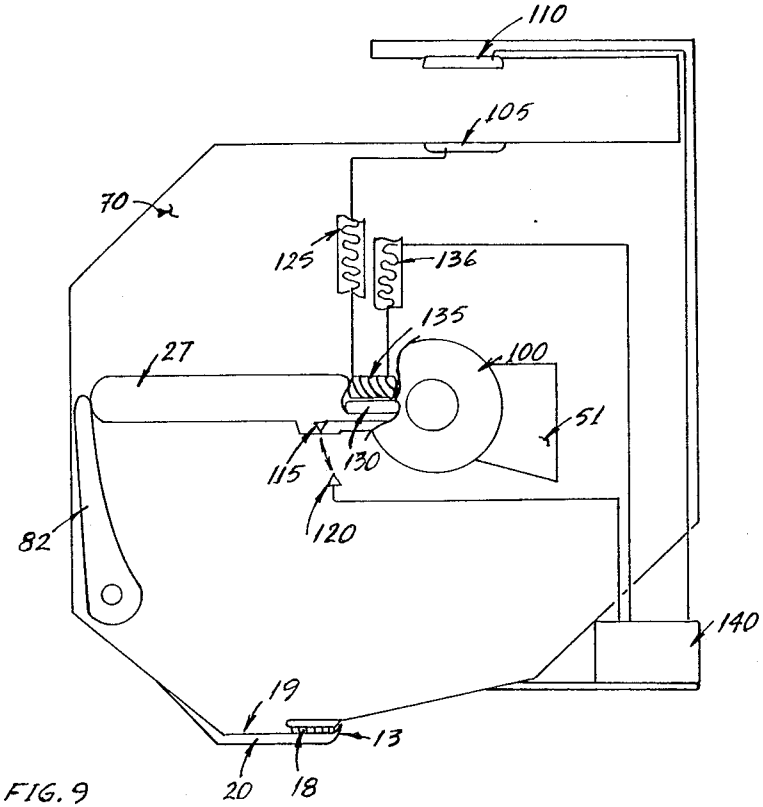
FIG. 9 is a view of the electrical elements and wiring for a totally hands-free dispensing mechanism.

The counter-clockwise movement of the outer driver gear 50 also causes its stopper arm 27 to move down and drop arm 82 to drop down as shown in FIG. 4. Thus the drop lip mechanism 20, attached to the drop arm through axle 22, is now free to rotate downwards thus opening up the bottom passage 19 at the bottom of the dispenser housing 15 (FIG. 5). Through this opening 19 now passes the released web of the tissue or towel roll. As the outer gear extension 25 is let go, the spring 17, attached from the body of housing to the outer gear plate 50, pulls the gear plate back to the original, released position. This action causes the stopper arm 27 to move back up pushing up the drop arm 82 and thereby causing the drop lip 20 to shut the bottom opening 19. This traps the release tissue or towel web in between the drop lip and the soft lining 18 (FIG. 5) of the dispenser bottom plate 26 (FIG. 9).

Repeated down and up motions of the outer gear extension 25 releases more and more of the tissue or towel web through the dispenser opening 19 as the roll keeps rolling in one counter-clockwise direction only (FIG. 5).

Finally, when an adequate length of the tissue or towel web has been dispensed, the outer gear extension 25 is let go.

Figure 7:
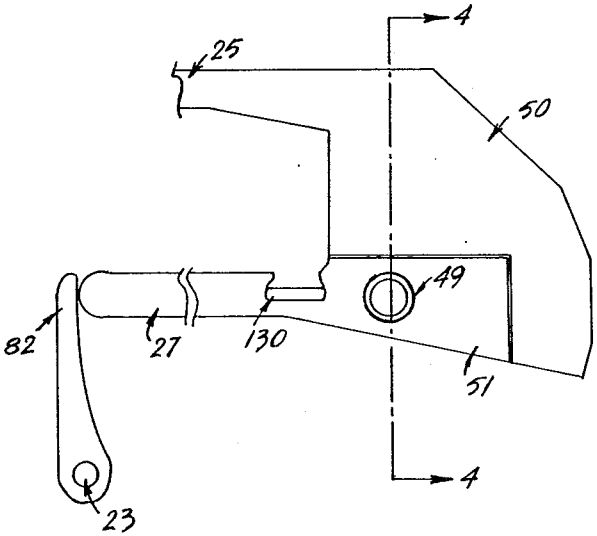
FIG. 7 is a view of the outer gear shown with the lifter pin only.

At this time, the drop arm 82 locks up the outer gear plate 50 in the original, released position by forcing back against the stopper arm 27. By carefully designing the lengths of the stopper arm 27 and drop arm 82, based on the size of the dispenser cabinet, the downward force exerted on the dipensed web at opening 19, that is, on the released portion of the web outside the cabinet, is transmitted as a downward force and a clockwise turning moment on axle 22 at mount 23 (FIG. 7). The downward force on the axle is transmitted into the dispenser cabinet body through the hole 23 and thus rendered harmless to the drive train, while the rotational moment about axle 22 results into a force acting on the drop arm 82. This force is then transmitted to the stopper arm 27 at the point of contact between the two arms. The direction of this force on the stopper arm is made to act above or through the center of the toothed gear axle 45. Such an arrangement neutralizes the downward drift of the outer gear extension arm and in fact, exerts a clockwise, upward turning moment on the outer gear 50 (FIG. 5). Further enhancement to this distribution of force is achieved by providing machined curved surfaces to the stopper arm length and to the tip of the drop arm 82 so as to increase the contact surface area and distribute the force.

The action described above provides means of locking up the outer gear 50 and thereby the drop lip 20 against the compressible lining 18 on the bottom and across the width of the cabinet opening plate 26 (FIG. 5). A line of sharp teeth 13 along the outer edge of the drop plate and pointed upwards provides the means for tearing off the dispensed web easily. The methodology for the hands-free operation as an option is as follows. First, the right side wall 10 of the dispenser housing 15 is removed (FIG. 11) and the upper portion of the outer gear 50 with the attached spring 17 are removed. The lower portion 51 and the stopper arm extension 27 (FIG. 7) are left as they are. The outer gear lower portion 51 has a small iron piece 130 located in its stopper arm 27. For the hands-free operation, the inner toothed gear plate 90 is detached from its stub male end 88 by unscrewing the connecting screw 12 (FIG. 2). A direct current motor 100 is then screwed on to the detached butt end 88 and wired up to a power supply 140 located at the bottom of the dispenser cabinet 15 (FIG. 9) The power supply contains the circuit electronics necessary for the switch devices.

Figure 10:
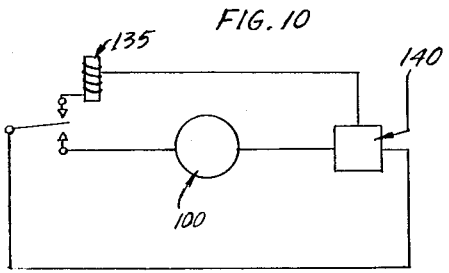
FIG. 10 is the electrical circuit schematic for the system shown in FIG. 8.

An electromagnet 135 (FIG. 9) is placed in a groove of the dispenser cabinet partitioning wall 70 (FIG. 2) and wired to the power supply 140 at one end and to a remote obstruction sensor switch, such as an optical sensor switch operating with a pair of infrared emitter and detector, at the other (FIG. 9). An electric circuit schematic is shown in FIG. 10. The far end 110 of the remote obstruction sensor switch (FIG. 9) is also connected to the power supply. Loose extension to the wires are provided in two narrow cylinders 125 and 136 to allow movement of the stopper arm 27 without stressing the wires (FIG. 9).

At the lower side of the stopper arm 27, a contact switch 115, wired to the motor 100, is placed in a groove designed to contain it. When the stopper arm moves down, the tip of contact switch 115 makes contact with its counterpart 120 which is connected to the power supply (FIG. 9).

In the idle condition, that is in the absence of any obstruction, the electromagnet 135 stays activated because part 105 of the remote obstruction sensor switch closes the circuit through its other switch end 110. When one intends to use the dispenser, one puts one's hand or an obstruction in between 105 and 110 switch ends. This breaks the circuit by decoupling the switch ends 105 and 110 and the electromagnet 135 is deactivated losing its grip on the stopper arm iron 130. The stopper arm 27 therefore drops under its own weight thereby letting the drop arm 82 drop also, which lets the drop lip 20 to rotate outward and open up the dispenser cabinet bottom opening 19 (FIG. 9).

As the stopper arm 27 goes down further, the switch 115 imbedded in it makes contact with its counterpart switch 120 and closes the loop for the electric motor 100. The motor 100 thus starts rotating immediately and with it the roll also rotates at the speed of the motor. The web of the tissue or towel therfore keeps rolling off the roll and keeps moving downward through the dispenser housing's bottom opening 19.

As soon as one removes one's hand or the obstruction from between the ends of the obstruction sensor switch, it is turned on, the electromagnet 135 is activated and the stopper arm 27 is pulled back upto its released position.

The stopper arm 27 in its return upward movement pulls back the drop arm 82 also thereby making the drop lip 20 shut the opening 19 (FIG. 9). The locking action of the drop arm 82 on the stopper arm 27, as has been explained hereabove, ensures that the tissue or towel web is grasped tightly between the soft material lining 18 of the bottom plate 26 and the drop lip 20. The web outside the dispenser housing coming off the dispenser web guide is available to be torn off at the sharp edge 13 (FIG. 9).

In case of moistened tissue or towel web, this web guide 5 also acts as a drop pan for collection of the dispensed web, especially in the case of moistened web.

When the manual or electrical power operation of the tissue or towel dispensing mechanism is not desired, the flap plate 29 (FIG. 4) is moved clockwise, the roll web is dropped through the slit opening 30; the web is then pulled to the required length, and manually torn off. The roll is free to rotate counter-clockwise.

Having thus described the invention, I claim:

1. A dispenser for dispensing a web from a roll of material comprising: a housing having a dispensing outlet, a shaft rotatably supporting the roll of web material in the housing, said shaft having at one end thereof a first toothed gear, said first toothed gear comprising a central body attached to said shaft, said first gear further comprising a plurality of teeth on the periphery of said central body, said dispenser further comprising a second gear rotatably mounted in said housing, said second gear further comprising a plurality of teeth pivotally mounted thereon around the outer periphery of the teeth of the first gear, the second gear further comprising protrusions, said protrusions being located near the teeth of the second gear and limiting the movement thereof, the teeth of the second gear hanging vertically downward unless obstructed by the teeth of the first gear or by the protrusions of the second gear, the teeth of the second gear having means to contact the teeth of the first gear, said second gear driving the first gear when the teeth of the second gear contact the teeth of the first gear to rotate the shaft and thus dispense the web through said dispensing outlet.

2. The dispenser of claim 1 wherein said housing has a bottom plate and a partitioning wall dividing the housing into large and small compartments, said second gear has a first upper arm to act as a lever and a second, lower arm to form part of a locking device, said second gear having a spring attached thereto and connected to said partitioning wall between said large and small compartments, said dispenser housing further having a freely rotating axle mounted in said large compartment and freely passing through a circular hole in said partitioning wall, a bent plate attached to said freely rotating axle in said large compartment, said bent plate covering said dispensing outlet of said large compartment, said freely rotating axle further comprising a third arm attached thereto in said small compartment, said third arm having means to contact said second arm of said second gear, wherein said bent plate tightly closes said dispensing outlet and tightly clamps said web material against said bottom plate mounted on the bottom of said large dispensing outlet of said housing, a compressible material lining on said bottom plate, said web being available for tearing across the width of said bent plate, said bent plate comprising a sharp array of teeth pointing upward at its outer edge across the width of the large compartment thereby facilitating said tearing of said web.

3. The dispenser of claim 2 wherein said bent plate has a narrow opening across its width, a flap plate rotatably mounted on said bent plate and covering said opening, said flap plate having a narrow strip of compressible material along its peripheral edges facing said bent plate, said dispenser further comprising a transparent front cover bent plate, said transparent cover bent plate showing thickness of said roll of web inside the said housing, said transparent bent plate has a narrow strip of compressible material along all its peripheral edges facing said dispenser housing, said housing having with a compressible material along the lengths of all its edges, said lining providing air tightness whereby said dispenser can contain a moistened roll of material without drying for a usuable period of time, said flap plate exposing said narrow opening whence said web is manually lowered through said narrow opening and said web manually torn off.

4. The dispenser of claim 1 wherein said shaft has multiple flat plates, said flat plates forming fins to snugly mount said roll of web material, said shaft further having smaller plates rotatably mounted on said shaft about an axis through their lower ends, said fins further having grooves shaped to snugly receive said smaller plates, said smaller plates, when raised parallel to said fins, accomodate rolls of large inner diameters, said shaft further comprising a stopper plate attached at one thereof and perpendicular thereto to provide an abutment for the roll, said shaft further comprising one cylindrical end and one a hollow end of non-circular cross-section; said hollow end fitting on a solid butt end of said inner gear.

5. A dispenser for dispensing a web from a roll of material comprising a housing having a dispensing outlet, a shaft rotatably supporting the roll of web material in the housing, a motor mounted on said shaft; said shaft having an arm, said arm having a recess, magnetic means mounted in said recess, said arm having a first electrical contact switch, a second electrical contact switch mounted in said housing, an electromagnet mounted in said housing adjacent said magnetic means, a first remote obstruction switch mounted on said housing, a second remote obstruction switch mounted on said housing spaced from said first remote obstruction switch and forming a gap therebetween, when the gap between said first and second remote obstruction switches is unobstructed, the electromagnet is activated to hold the arm through pull exterted on the magnetic means, when the gap between said first and second switches is obstructed, said electromagnet releases the arm allowing the first electrical contact switch to contact the second electrical contact switch to energize the motor, the motor rotating the shaft to dispense said web through said dispensing outlet.

6. The dispenser of claim 5, wherein said dispenser housing further has a bottom plate and a freely rotating axle, a bent plate attached to said freely rotating axle, said bent plate covering said dispensing outlet, said freely rotating axle further comprising a second arm attached thereto, said second arm having means to contact said arm of said shaft, said bent plate tightly closing said dispensing outlet and further tightly clamping said web material against said bottom plate mounted on the bottom of said dispensing outlet, a compressible material lining on said bottom plate; said web being available for tearing across the width of said bent plate, said bent plate comprising a sharp array of teeth pointing upward at its outer edge across the width of the large compartment thereby facilitating tearing of said web.

* * * * *